US010026117B1

(12) United States Patent
Arbel et al.

(10) Patent No.: US 10,026,117 B1
(45) Date of Patent: Jul. 17, 2018

(54) REAL-TIME ISSUER BIDDING TO COMPETE FOR USE OF ELECTRONIC PAYMENT INSTRUMENT BY CONSUMER

(75) Inventors: Eran Arbel, Los Altos, CA (US); Boris A. Fedorov, San Francisco, CA (US)

(73) Assignee: INTUIT INC., Mountain View, CA (US)

( * ) Notice: Subject to any disclaimer, the term of this patent is extended or adjusted under 35 U.S.C. 154(b) by 1718 days.

(21) Appl. No.: 13/284,740

(22) Filed: Oct. 28, 2011

(51) Int. Cl.
*G06Q 30/00* (2012.01)
*G06Q 30/08* (2012.01)

(52) U.S. Cl.
CPC ..... *G06Q 30/08* (2013.01)

(58) Field of Classification Search
None
See application file for complete search history.

(56) References Cited

U.S. PATENT DOCUMENTS

| | | | | |
|---|---|---|---|---|
| 5,920,848 | A | 7/1999 | Schutzer et al. | |
| 6,487,540 | B1 | 11/2002 | Smith et al. | |
| 6,738,749 | B1 | 5/2004 | Chasko | |
| 6,792,411 | B1 * | 9/2004 | Massey, Jr. | 705/35 |
| 7,987,120 | B2 | 7/2011 | Shiftan et al. | |
| 8,019,667 | B1 | 9/2011 | Bent et al. | |
| 8,554,192 | B2 * | 10/2013 | Ramer et al. | 455/418 |
| 8,590,785 | B1 * | 11/2013 | Mesaros | 235/383 |
| 2002/0038270 | A1 * | 3/2002 | Shin et al. | 705/36 |
| 2003/0014267 | A1 | 1/2003 | Culp | |
| 2003/0055733 | A1 | 3/2003 | Marshall et al. | |
| 2003/0126020 | A1 | 7/2003 | Smith et al. | |
| 2004/0220964 | A1 | 11/2004 | Shiftan et al. | |
| 2004/0260575 | A1 * | 12/2004 | Massey, Jr. | 705/1 |
| 2005/0044017 | A1 | 2/2005 | Foss, Jr. et al. | |
| 2005/0144105 | A1 | 6/2005 | Czyzewski | |
| 2005/0149436 | A1 | 7/2005 | Elterich | |
| 2005/0187862 | A1 | 8/2005 | Dheer et al. | |
| 2006/0038003 | A1 | 2/2006 | Wakasa et al. | |

(Continued)

OTHER PUBLICATIONS

Office Action dated Jan. 17, 2012, Amendment dated Apr. 16, 2012, Interview Summary dated Apr. 17, 2012 and Final Office Action dated Jun. 19, 2012 in U.S. Appl. No. 12/752,083, filed Mar. 31, 2010, (56 pages).

(Continued)

*Primary Examiner* — Zeshan Qayyum
(74) *Attorney, Agent, or Firm* — Vista IP Law Group LLP

(57) ABSTRACT

Issuers of electronic payment instruments can bid or submit competing offers to consumers in real-time during a transaction to influence consumers selecting their electronic payment instruments to complete a pending electronic transaction. Requests for bids, issuer responses with offers or proposed terms (e.g., annual percentage rate, miles, points, cash back, etc.), analysis of competing issuer offers, and selection of an electronic payment instrument based on the offer analysis occur in real-time such as while the consumer is at an electronic payment device of a merchant. An electronic payment instrument may be selected for the consumer, e.g., the instrument associated with an offer that confers the greatest benefit to the consumer compared to other offers, or the offer data can be presented to the consumer such as in the form of a ranking or list so that the consumer can select the electronic payment to be utilized to complete the transaction.

27 Claims, 10 Drawing Sheets

(56) References Cited

U.S. PATENT DOCUMENTS

| | | | | |
|---|---|---|---|---|
| 2006/0064372 | A1* | 3/2006 | Gupta | 705/39 |
| 2006/0259421 | A1* | 11/2006 | Maass | 705/39 |
| 2006/0273163 | A1 | 12/2006 | Gusler et al. | |
| 2007/0069013 | A1 | 3/2007 | Seifert et al. | |
| 2007/0094087 | A1 | 4/2007 | Mitchell et al. | |
| 2007/0288322 | A1 | 12/2007 | Watanabe | |
| 2008/0059303 | A1 | 3/2008 | Fordyce | |
| 2008/0208762 | A1 | 8/2008 | Arthur et al. | |
| 2008/0235749 | A1 | 9/2008 | Jain et al. | |
| 2009/0271265 | A1 | 10/2009 | Lay et al. | |
| 2010/0017325 | A1* | 1/2010 | Scherpa et al. | 705/39 |
| 2010/0070359 | A1* | 3/2010 | Heasley et al. | 705/14.17 |
| 2010/0287058 | A1 | 11/2010 | Rosskamm et al. | |
| 2010/0325047 | A1 | 12/2010 | Carlson et al. | |
| 2011/0029430 | A1 | 2/2011 | Norris et al. | |
| 2011/0125598 | A1 | 5/2011 | Shin et al. | |
| 2012/0005029 | A1* | 1/2012 | Lang et al. | 705/14.71 |

OTHER PUBLICATIONS

Office Action dated Oct. 3, 2011, Amendment dated Feb. 3, 2012, Final office Action dated Apr. 5, 2012 and Interview Summary dated Aug. 14, 2012 in U.S. Appl. No. 12/625,540, filed Nov. 24, 2009, (52 pages).

Office Action dated Oct. 3, 2012 in U.S. Appl. No. 13/284,760, filed Oct. 28, 2011, (9 pages).

* cited by examiner

500

| 502a | 502b | 502c | 502d |
|---|---|---|---|
| Consumer Identification (215) | Electronic Payment Instrument (250) | Issuer (245) | Default Terms (251d) |
| Consumer 1 | Credit Card 1 | Issuer 1 | Default Terms 1 |
| | Credit Card 2 | Issuer 2 | Default Terms 2 |
| | Credit Card 3 | Issuer 3 | Default Terms 3 |
| | Credit Card 4 | Issuer 4 | Default Terms 4 |
| | Credit Card 5 | Issuer 5 | Default Terms 5 |

...

| | | | |
|---|---|---|---|
| Consumer 2-n | Payment Instruments | Issuers | Default Terms |

Fig. 5

(From Fig. 6, 614)

↓

616 – Issuer computers generate data indicating whether consumer is authorized to use electronic payment instrument

↓

618 – Issuers participating in real-time bidding process determine bid or offer to fund electronic transaction based at least in part upon electronic transaction data and default terms of issuer's electronic payment instrument

↓

620 – Participating issuers transmit respective responses including offers with proposed terms and conditions (and authorization decisions as necessary) to payment selection computer

↓

622 – Transaction authorized and offer received at bid computer from computer of issuer of electronic payment instrument?

↓ ↓

N Y

↓ ↓

624 – Issuer / electronic payment instrument not considered ← N ← 626 – Offers received at bid computer within pre-determined time?

↓

Y

↓

Fig. 7

Fig. 6 (cont'd)

702 - Issuers transmit offers with proposed terms and conditions (and authorization determinations as necessary) to bid computer

↓

704 – Bid computer determines proposed terms of received offers of issuers participating in real-time bidding process and, as necessary, default terms of electronic payment instruments of issuers not participating in real-time bidding process or that did not timely respond to bid computer request

↓

706 – Bid computer normalizes or standardizes term(s) of issuer offers as necessary

↓

708 – Bid computer compares proposed terms of issuer offers for electronic payment instruments of issuers participating in real-time bidding process and, as necessary, default terms of other non-participating or late-responding issuers

↓

710 – Bid computer transmits additional request for stronger offer / best offer to one or more issuers as necessary (e.g., if issuer indicated that issuer would match or beat other offers)

↓

712 – Bid computer receives any additional offers and normalizes or standardizes additional offers as necessary

↓

714 – Bid computer compares terms of received offers

↓

716 – Bid computer selects electronic payment instrument or generates list of ranked electronic payment instruments based at least in part upon comparison

Fig. 7

(From Fig. 7, 716)

↓

718 – Bid computer transmits data of selected electronic payment instrument or list together with data of comparison or bid response terms as necessary to mobile communication device

↓

720 – Modify selection of electronic payment instrument or order of list as necessary (e.g., if consumer input that certain term is more important than other terms)

↓

722 – Consumer confirms that selected electronic payment instrument is to be utilized or selects electronic payment instrument from list generated by payment selection computer

↓

724 – Electronic transaction completed with selected electronic payment instrument

↓

726 – Consumer receives benefit of using selected electronic payment instrument according to proposed terms of accepted issuer offer (or according to default terms as appropriate)

Fig. 7 (cont'd)

REAL-TIME ISSUER BIDDING TO COMPETE FOR USE OF ELECTRONIC PAYMENT INSTRUMENT BY CONSUMER

BACKGROUND

Embodiments are generally related to electronic commerce and, more particularly, to electronic payments made by a consumer to a merchant. Customers or consumers of merchant stores or retail establishments often pay for goods or services using a payment or transaction card such as a credit card, debit card and prepaid payment card. For this purpose, a merchant may manually enter credit card data into a payment terminal or the consumer or merchant may swipe the card through a payment terminal to complete the transaction, or the consumer may make an on-line purchase through a merchant's website. Such payment or transaction cards have been utilized for a number of years.

Some consumers utilize mobile communication devices for making payments to merchants, e.g., using a smartphone that includes a payment application or software program that is operable as a mobile wallet. Thus, rather than payment by cash, check or credit card, a consumer utilizes a mobile communication device for payment. For example, certain known mobile wallet devices allow a user to "tap" the smartphone on a merchant reader or electronic payment device to establish a connection with the reader or device allowing the smartphone to send payment or transaction card data to the merchant to pay the merchant for the item purchased.

While many electronic transactions have been successfully completed using electronic payment instruments such as credit cards, which have been utilized for years, and mobile wallets have more recently been utilized, current electronic payment systems and methods have significant limitations and shortcomings with respect to how consumers decide which payment or transaction card to utilized, particularly in real-time during a transaction or at the point of sale where the consumer may not know or consider the various benefits available to the consumer depending on which electronic payment instrument is utilized for the transaction, and the consumer is in line with other consumers waiting to purchase their items.

Consumers typically carry a wallet and carry multiple credit cards, and these same credit cards may also be part of a mobile wallet application that allows the consumer to make payments using a smartphone. It is estimated that an average U.S. consumer carries 4.4 credit cards in their wallet, and many consumers have more, and these credit cards may be from different issuing financial institutions, each of which has a different contacts or terms and conditions that specify terms such as interest rates, payment cycles, and rewards (if rewards are offered).

However, consumers may not know or may not remember the terms and conditions of the contract that governs their use of their various credit or other transaction or payment card such as interest rates and rewards terms, and issues are increasingly problematic the more credit cards a consumer has. Thus, if a consumer carries five credit cards, for example, there may be five different sets of terms and conditions that apply to each of the five different credit cards such that credit cards may involve five different annual percentage rates (APRs) and five different rewards programs, each of which may also have certain requirements or restrictions and may involve different types of rewards such as cash back, miles, points, etc. Thus, it can be very confusing to consumers to know exactly what terms and conditions apply to a credit card, particularly considering that issuers often update or change terms and conditions, and certain terms and conditions (such as interest rate) may be fixed rates or variable rates that adjust depending on factors such as the prime rate, credit available and balance.

Current systems and methods are also associated with limitations on issuers and card associations with regard to the limited ability to reach out to consumers to try to influence consumers to use their cards. More specifically, once a card is issued to a consumer, issuers do not have an effective method to influence consumer choice or behavior to select the issuer's card for a given purchase. Instead, issuers are often left to resort to general mail and e-mail advertisements, but such advertisements are often ignored by consumers and do have only a small impact, if any, on a consumer at the time of purchase.

Thus, current electronic payment systems and methods present shortcomings and limitations on both consumers and issuers.

SUMMARY

Embodiments relate to enhancing or maximizing benefits to consumers that utilize electronic payment instruments by providing a framework that allows issuers of electronic payment instruments to bid or compete for the transaction and try to influence a consumer to select an issuer's electronic payment instrument. For this purpose, embodiments analyze or compare offers submitted by issuers in real-time to determine the "best offer" and which electronic payment instrument should be selected as providing an enhanced or most benefit to the consumer. Embodiments are performed in real-time, during a transaction, and may involve a consumer utilizing a mobile communication device operable as a mobile wallet to pay a merchant.

Embodiments are directed to methods performed by or involving, systems of or utilized by, and articles of manufacture, computer program products and downloadable mobile applications of or utilized by one or multiple parties of involved in the electronic transaction. Parties involved in an electronic transaction include a consumer that carries a mobile communication device operable as a mobile wallet, a merchant that utilizes an electronic payment device, an intermediate or bid analysis or management computer that serves as an interface between the consumer's mobile communication device and computers of issuers of electronic payment instruments. During a transaction, the bid analysis computer requests and receives competing offers or bids from issuers, analyzes the terms of the offers, and identifies electronic payment instruments that maximize a benefit to the consumer based on the offer analysis.

One embodiment is directed to a computer-implemented method for real-time electronic bidding by issuers to select an electronic payment instrument to be utilized by a consumer. The method comprises receiving electronic transaction data from a consumer's mobile communication device at an intermediate or bid analysis computer, in real-time during the transaction. For example, an electronic transaction may be initiated by establishing a wireless connection between the mobile communication device and the merchant's electronic payment device by the consumer "tapping" an electronic payment device or brining the mobile communication device in close proximity to the electronic payment device such that electronic transaction data is transmitted to and received by the mobile communication device. The mobile communication device includes data of electronic payment instruments permitting it to be used as a mobile wallet such that a consumer can pay for a purchase using the mobile communication device. The method further comprises the bid analysis computer transmitting the electronic transaction data and respective bid requests to respective computers of respective issuers of respective electronic payment instruments that are available for use by the consumer. The method further comprises receiving respective responses to bid requests from respective issuer computers at the bid analysis computer. Each response comprises an offer by an issuer that would apply if the electronic instrument of the issuer is utilized for the transaction. The method further comprises the bid analysis computer comparing offers to determine which offers is the "best" offer and which electronic payment should be selected. The bid analysis computer or the consumer selects an electronic payment instrument based at least in part upon the offer comparisons to complete the pending transaction.

A further embodiment is directed to a method for receiving real-time electronic bids of issuers of respective electronic payment instruments of a mobile communication device utilized by a consumer as a mobile wallet. The method comprises receiving electronic transaction data at the mobile communication device from an electronic payment device of a merchant in real-time during the transaction, and transmitting the electronic transaction data from the mobile communication device to a bid analysis computer in real-time during the transaction. The bid analysis computer requests bids from respective computers of respective issuers of respective electronic payment instruments and receives respective responses from respective issuer computers. Each response includes an offer by an issuer that would apply if the electronic instrument of the issuer is utilized by the consumer to complete the pending transaction. The method further comprises receiving, at the mobile communication device, results of the bid analysis computer comparing issuer offers, an electronic payment instrument being selected to complete the pending transaction based at least in part upon the comparison.

A further embodiment is directed to a computer-implemented method for submitting real-time electronic bids to vie for selection of an electronic payment instrument to be utilized by a consumer to complete a pending electronic transaction. The method comprises receiving, in real-time during a transaction, electronic transaction data and a bid request at an issuer computer from a bid analysis computer, which is in communication with a mobile communication device of the consumer, which is in communication with an electronic payment device of a merchant and includes data of electronic payment instruments and being operable as a mobile wallet. The method further comprises transmitting, in real-time during the transaction, a response to the bid request from the issuer computer to the bid analysis computer. The response includes an offer by the issuer that would apply if the electronic instrument of the issuer is utilized for the transaction. If the electronic payment instrument of the issuer is selected to complete the pending transaction, the issuer processes the transaction and rewards the consumer with a benefit specified by the accepted offer.

Other embodiments are directed to systems for real-time electronic bidding by issuers to select an electronic payment instrument to be utilized by a consumer, receiving real-time electronic bids of issuers of respective electronic payment instruments of a mobile communication device, and submitting real-time electronic bids to vie for selection of an electronic payment instrument to be utilized by a consumer to complete a pending electronic transaction. For example, one embodiment is directed to a system for real-time electronic bidding by issuers to select an electronic payment instrument to be utilized by a consumer and comprises a bid analysis computer that is in communication between a mobile communication device of a consumer that includes electronic payment instrument data and that is operable as a mobile wallet and respective computers of respective issuers through respective networks. The bid analysis computer is operable or configured to receive electronic transaction data from the mobile communication device in real-time during the transaction, transmit the electronic transaction data and respective bid requests to respective computers of respective issuers of respective electronic payment instruments, receive respective responses from respective issuer computers, each response comprising an offer by an issuer that would apply if the electronic instrument of the issuer is utilized for the transaction, and compare received offers for use in selecting an electronic payment instrument that will be utilized to complete the pending transaction. Systems may include only a bid analysis a computer, only a mobile communication device, only an issuer computer, or a combination of one or more or all three system components.

Additional embodiments are directed to computer program products such as mobile applications that can execute on a mobile communication device such as a smartphone, and which comprises a non-transitory, computer readable storage medium or that resides on a mobile communication device and having a sequence of instructions which, when executed by a computing or mobile communication device, cause one or more processors to execute a process for receiving real-time electronic bids of issuers of respective electronic payment instruments of the mobile communication device, the process comprising: receiving or determining electronic transaction data generated by an electronic payment device of a merchant in real-time during the transaction, transmitting the electronic transaction data from the mobile communication device to a bid analysis computer in real-time during the transaction, the bid analysis computer requesting bids from respective computers of respective issuers of respective electronic payment instruments and receiving respective responses from respective issuer computers, each response comprising an offer by an issuer that would apply if the electronic instrument of the issuer is utilized by the consumer to complete the pending transaction, and receiving, at the mobile communication device, results of the bid analysis computer comparing issuer offers, an electronic payment instrument being selected to complete the pending transaction based at least in part upon the comparison.

In a single or multiple embodiments, authorization of the electronic payment instrument such as a credit or other payment card for the transaction is separate and different than bid request and offer responses. In one embodiment, authorization requests are independent of embodiments and transmitted from merchant, to acquirer to issuer and back to the merchant. In another embodiment, the bid analysis computer may transmit authorization requests such that the bid analysis computer may serve as an acquirer. In such embodiments, the authorization request may be transmitted directly or indirectly to an issuer simultaneously with a bid request. Thus, for example, if an issuer approves of the transaction (e.g., the transaction would not cause the consumer to exceed a credit limit of a credit card) and also wants to submit a bid response or offer, the authorization or approval and the response with offer can be transmitted to the bid analysis computer, which may then analyze or compare the issuer offer with other offers, and communicate with the merchant payment device as necessary regarding authorization or approval.

In a single or multiple embodiments, the transmission of electronic transaction data (such as identification of the consumer and a transaction amount, and additional data as necessary such as merchant identification and item(s) purchased), bid requests, responses with offers, and analysis of offers are performed in real-time while the consumer is at a merchant location or establishment, e.g., while at an electronic payment device of a merchant and after a consumer has initially established a wireless connection or "tapped" the merchant's electronic payment device with a mobile communication device. In another embodiment, the transmission of electronic transaction data, bid requests, responses with offers, and analysis of offers are performed in real-time while the consumer is at a remote location relative to the merchant, e.g., at home or elsewhere, and using a computer or mobile communication device.

In a single or multiple embodiments, the electronic payment instrument compares or analyzes competing bids of issuers, or in cases in which an offer is not submitted by an issuer or the issuer does not timely respond, with default terms already applicable to an electronic payment instrument, and selects an electronic payment instrument for the consumer who may then approve or confirm that the electronic payment instrument should be utilized. The bid analysis computer may be configured to select the electronic payment instrument of the issuer that has provided the strongest offer or bid, or the offer or bid that provides the greatest benefit to the consumer. According to another embodiment, the bid analysis computer does not select a particular electronic payment instrument and instead notifies the consumer of how rewards or benefits of available electronic payment instruments compare, e.g., in the form of a list that ranks electronic payment instruments according to the benefits conferred to the consumer, which is provided to the consumer who may then view the results generated by the bid analysis computer and select an electronic payment instrument. For example, the bid analysis computer may analyze offers or bids (and default terms as necessary) related to a financial term such as APR or a rewards term such as points, miles or cash back. The offer or bid may be specific to the particular pending transaction.

In a single or multiple embodiments, the bid analysis computer compares only terms of offers submitted by issuers in response to bid requests. The offers submitted by issuers may all include terms that are better than default terms or terms of a contract to which the consumer has already agreed with respect to that particular electronic payment instrument of that particular issuer. In other embodiments, the bid analysis computer compares terms of offers submitted by issuers in response to bid requests and default terms such that, for example, the bid analysis computer may select or identify an electronic payment instrument associated with the best offer if that offer maximizes the benefit conferred to a consumer, or an electronic payment instrument that was not the subject of a response or offer if a default term of that electronic payment instrument would provide a greater benefit to the consumer compared to other offer terms and other default terms of other electronic payment instruments of other consumers.

For example, a default term may involve a cash back percentage that is greater than cash back percentage offers of other issuers provided in response to bid requests. Thus, the bid analysis computer may identify or select an electronic payment instrument that was the subject of a bid request and response process or one that was not, but was the subject of comparison by the bid analysis computer.

As another example, a default term may include a default APR, and the proposed term of an offer submitted in response to a bid request may include an APR that is lower than the default APR such that the bid analysis computer would select or rank the electronic payment instrument associated with the lower APR higher than other electronic payment instruments associated with higher APRs. As another example, a default term may include a default number of points or miles per dollar spent, and the proposed term of an offer submitted in response to a bid request may include a number of points or miles per dollar spent that is greater than the default amount, in which case the bid analysis computer would select or rank the electronic payment instrument associated with the higher number of points or miles higher than other electronic payment instruments associated with lower points or miles.

In a single or multiple embodiments, the bid requests sent by the bid analysis computer have a temporal restriction such that the issuer must respond with an offer or bid within a pre-determined amount of time, or else a default term would be considered or the issuer's electronic payment instrument may not be considered at all.

In a single or multiple embodiments, the issuer offers involve the same type or category of term so that the bid analysis can compare issuer offers directly. For example, the bid analysis computer may compare a first APR of a first offer of a first issuer and a second APR of a second offer of a second issuer, or the bid analysis computer may compare reward program terms such as a first number of miles for a transaction amount when using a first electronic payment instrument of a first issuer and a second number of miles for the same transaction amount when using a second electronic payment instrument of a second, issuer.

Embodiments may also involve the bid analysis computer comparing different types or categories of proposed terms of different issuer offers. For example, the bid analysis computer may compare an offer from a first issuer involving an APR, another offer involving a number of points, and another offer involving a number of miles. For this purpose, the bid analysis computer may transform or normalize different types of proposed terms of respective issuer offers into a common metric or standard or based on a common type or unit comparison, and then compare the normalized offers to determine which one would be most beneficial to the consumer.

Thus, with embodiments, the bid requests, responses with offers, and comparison analysis and normalization (if necessary) of offers may occur in real-time, after a wireless connection is established between the mobile communication device and an electronic payment device of the merchant, but before the transaction is completed using a particular electronic payment instrument, and embodiments may executed in a matter of seconds such that embodiments operate transparently to the consumer and merchant.

BRIEF DESCRIPTION OF THE DRAWINGS

The foregoing and other aspects of embodiments are described in further detail with reference to the accompanying drawings, wherein:

FIG. 5 illustrates a table or database of a bid computer including data of various consumers and their electronic payment instruments;

FIG. 7 is a flow diagram illustrating process steps according to embodiments for normalizing and comparing proposed terms and conditions of issuer offers received at a bid computer in real-time during an electronic transaction and selecting or ranking electronic payment instruments.

Figure 1:
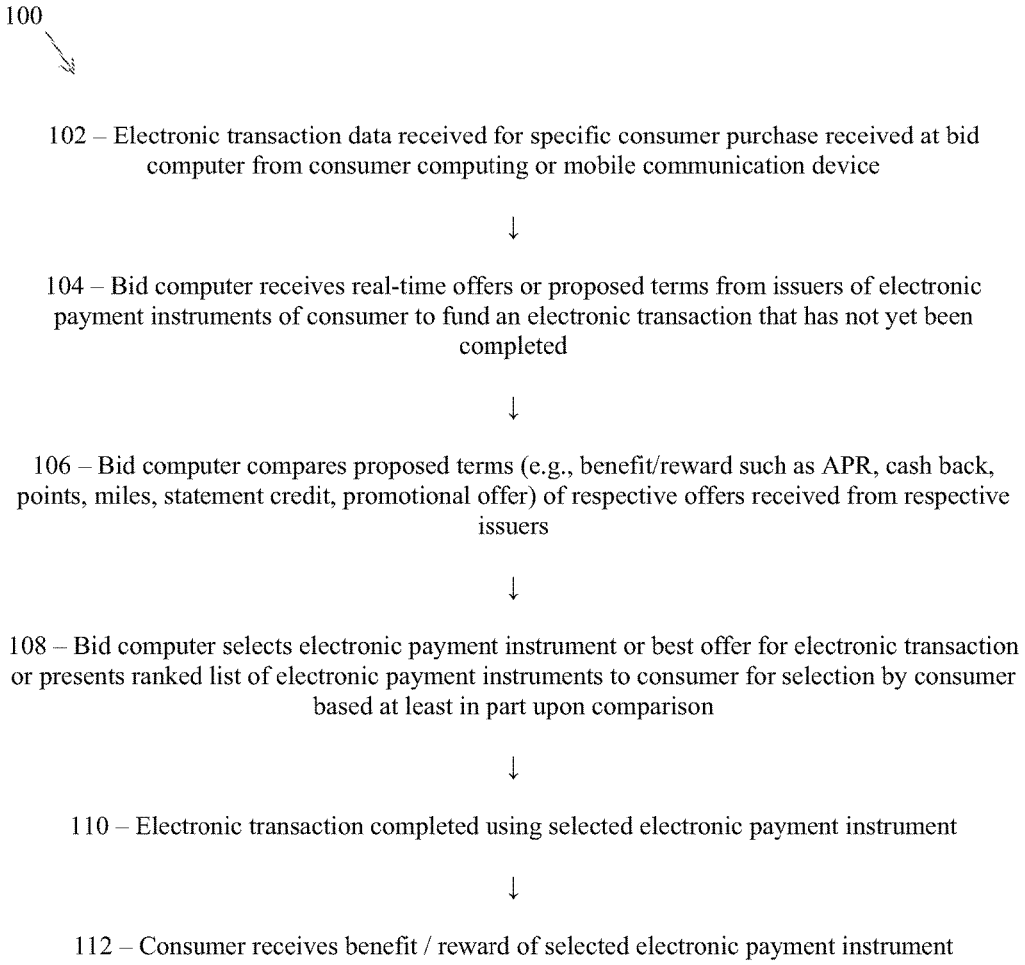
FIG. 1 is a flow diagram of one embodiment of a method for allowing issuers of electronic payment instruments to bid or compete for use of their electronic payment instruments to complete an electronic transaction.

In order to better appreciate how to obtain the above-recited and other advantages and objects of various embodiments, a more detailed description of embodiments is provided with reference to the accompanying drawings. It should be noted that the drawings are not drawn to scale and that elements of similar structures or functions are represented by like reference numerals throughout. It will be understood that these drawings depict only certain illustrated embodiments and are not therefore to be considered limiting of scope of embodiments.

DETAILED DESCRIPTION OF ILLUSTRATED EMBODIMENTS

Embodiments relate to processing of electronic transactions involving a merchant and a consumer that pays for an item using a mobile communication device that may serve as a mobile wallet with electronic payment instruments or other consumer computing or communication apparatus, while providing the consumer with real-time analysis of which electronic payment instrument should be utilized in order to maximize or increase financial or other benefits to the consumer by allowing issuers of the consumer's electronic payment instruments to vie or bid for the transaction with offer competing offer terms. Competing offer terms may include, for example, one or more or all of and combinations of an annual percentage rate (APR) or interest rate, number of miles, number of points, cash back and other reward terms that the issuer is willing to offer to the consumer in exchange for the use of the issuer's electronic payment instrument to complete the transaction.

In this manner, embodiments provide an intelligent, real-time link and interface at the point-of-sale between a mobile wallet or other communication or computing device that can be utilized for electronic payment and issuers. Embodiments automatically maximize or enhance benefits conferred to consumers for payments they would otherwise make, empower consumers with additional information, and provide a conduit to issuers to provide consumers with offers at the point of sale and in real time during a transaction and before the consumer has decided which electronic payment instrument to utilize. Embodiments can be applied to individual, specific transactions.

For example, referring to FIG. 1, one computer-implemented method 100 embodiment comprises, at 102, a bid or offer analysis computer (generally, "bid computer") receiving electronic data related to a purchase by a consumer from a merchant and from a computing or mobile communication device of the consumer. At 104, the bid computer receives offers or proposed terms from issuers of the consumer's electronic payment instruments. The offers are submitted by the issuers to vie or compete to fund the electronic transaction that has not yet been completed. At 106, the bid computer compares proposed terms of the received offers (e.g., benefits or rewards such as APR or interest rate, cash back, points, miles, a statement credit, promotional offer, discount or coupon) of respective offers received from respective issuers, and at 108, selects an electronic payment instrument associated with the best or other identified offer for electronic transaction based at least in part upon the comparison. The bid computer may also present a ranked list of electronic payment instruments generated based at least on the comparison to consumer so that the consumer can consider the bid computer results and select an electronic payment instrument for the transaction. At 110, the electronic transaction completed using selected electronic payment instrument, and at 112, the consumer receives the benefit or award according to the accepted offer terms associated with the electronic payment instrument that was selected. Further aspects of embodiments are described with reference to FIGS. 2-8.

Figure 2:
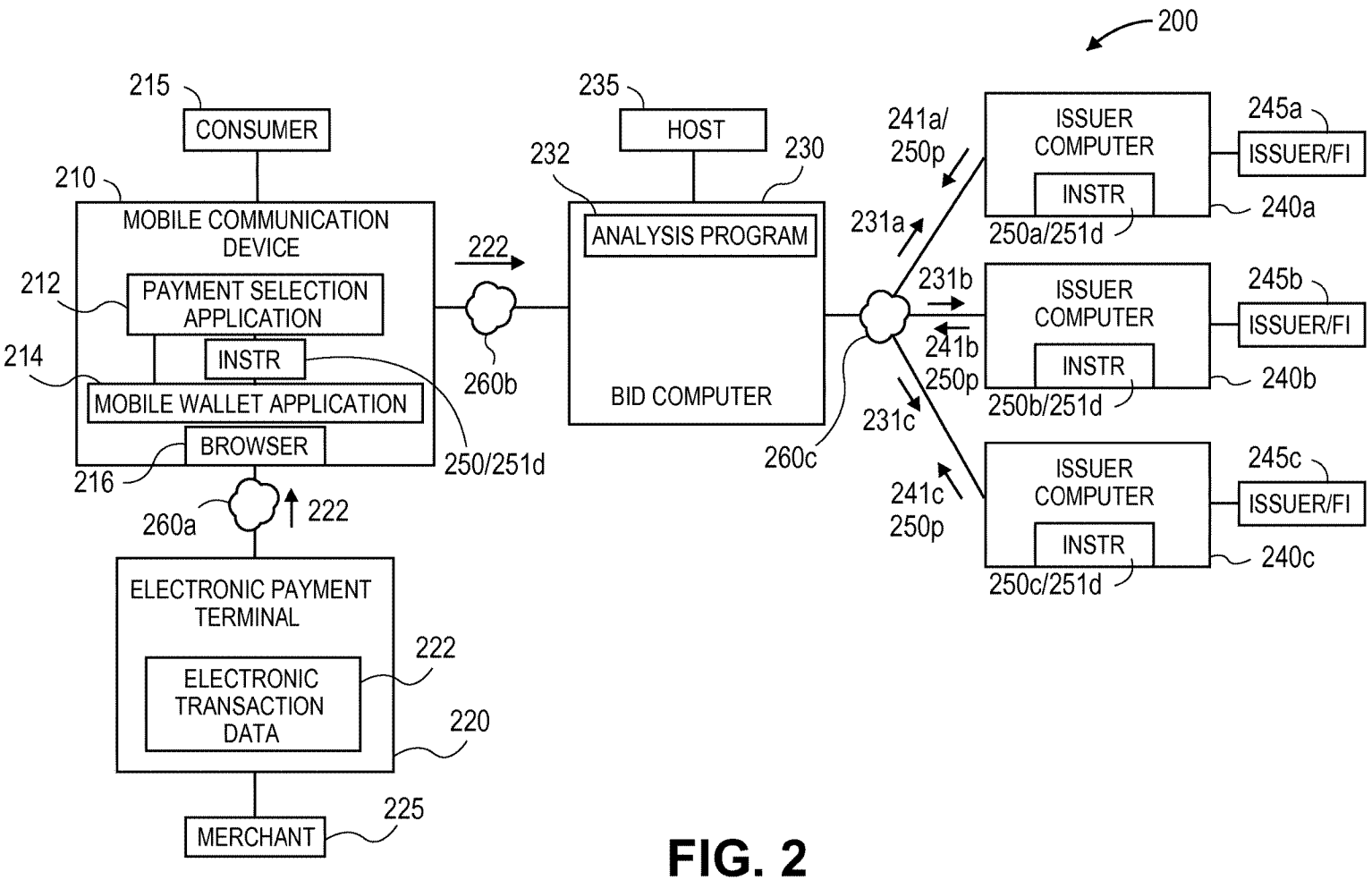
FIG. 2 is a block diagram of a system constructed according to one embodiment for allowing issuers of electronic payment instruments to bid or compete for use of their electronic payment instruments to complete an electronic transaction.

Referring to FIG. 2, a system 200 constructed according to one embodiment involves or comprises one or more or all of a computing or mobile communication device 210 (generally, "mobile communication device") of a consumer 215, an electronic payment terminal or device 220 of a merchant 225, an intermediate bid or offer analysis computer 230 (generally, "bid computer") of a host 235 that that manages requests 231 for bids of offers from issuers 245 or other financial institutions 245 ("FI" in FIG. 2), and receiving responses with issuer offers 241 with proposed terms from issuer computers 240. The computing or mobile communication device 210 may be a computer or mobile communication device such as a smartphone that executes a payment selection program or application 212 (generally, "payment selection application") that is utilized to read or determine electronic transaction data 222 and communications between the mobile communication device 210 and the bid computer 230.

According to one embodiment, the consumer's mobile communication device 210 serves as a mobile wallet that can be tendered by the consumer 215 to the merchant 225 to pay for an item, good or service (generally, "item") offered by the merchant 225. For this purpose, the mobile communication device 210 or mobile wallet may involve or authorize various types of electronic payments using electronic payment instruments 250 ("Instr" in FIG. 2) governed by default contracts or terms and conditions (generally, terms

251*d*) ("d" indicating "default") including, but not limited to credit card, debit card, ATM card, ACH, eCheck, PAYPAL and other forms of electronic payment (generally, "electronic payment" or "credit card") capable of being made or authorized using the mobile communication device 210. For ease of explanation, reference is made to a mobile communication device 210 or mobile wallet and a credit card 250.

Mobile communication device 210 may be a smartphone such as the IPHONE from Apple, Inc., a personal digital assistant (PDA) or tablet computing device such as an IPAD that has cellular telephone or wireless communication capabilities. In the illustrated embodiment, the mobile communication device 210 is a smartphone that includes a mobile wallet application 214 and a separate payment selection application 212. The mobile wallet application 214 can be executed to make electronic payments utilizing data of electronic payment instruments 250 such as credit cards on the mobile communication device 110, and the payment selection application 212 according to embodiments is utilized to determine which form of payment 250 should be utilized by the mobile wallet application 214. FIG. 1 illustrates the payment selection application 212 and the mobile wallet application 214 as separate applications to illustrate how embodiments are different compared to known mobile wallet applications 214, but it will be understood that other system 200 and application configurations can be utilized according to embodiments.

For use as a mobile wallet, a web browser 216 or other navigation program executes on the mobile communications device 210 to allow the consumer 210 to navigate screens or pages generated by the mobile wallet application 214, which may present electronic payment options to the consumer 210. Examples of web browsers 216 that may be used for this purpose include, for example, INTERNET EXPLORER, NETSCAPE NAVIGATOR, FIREFOX, OPERA, AVANT Browser, GOOGLE CHROME, and FLOCK. Non-web browser software that is also capable of displaying payment options and receiving consumer 215 input utilizing the mobile communication device 210 may also be utilized for this purpose. Mobile wallet payments may be made with a dedicated mobile wallet application 214 or other application capable of executing and navigating a mobile wallet application 214.

Merchant 225 may be an in-store or brick and mortar merchant such that certain embodiments involve the consumer 215 visiting a merchant 225 store to make a purchase. In these embodiments, the merchant 225 may utilize an electronic payment device or terminal 220 in the form of a Point-Of-Sale (POS) or payment terminal or other terminal for accepting and processing electronic payments. Other embodiments involve the consumer 215 at a location that is remote relative to the merchant 225 location, e.g., using a mobile communication device or computer 210 for an on-line purchase from the merchant 225.

Merchant 225 may also utilize an electronic payment device 220 in the form of a mobile communication device configured for processing electronic transactions so that a transaction involves multiple mobile communication devices 210, 220. The consumer 215 and the merchant 225 may be in the merchant store or office, or the consumer 215 and merchant 225 may be at a location other than the merchant store or office, e.g., at various residential, commercial and retail locations, offices, job sites, etc. Further, mobile merchants 225 can accept payments at various times including at times during which a merchant store is closed. For this purpose, a mobile payment application can be downloaded onto the merchant's mobile communication device 220, and a web browser may execute on the merchant's mobile communications device 220 to allow the merchant 125 to navigate screens or pages generated by the mobile payment application. Examples of mobile payment applications that can utilized or configured for use in embodiments include GOPAYMENT, available from Intuit Inc., CHARGE ANYWHERE Mobile POS software, Transaction Wireless and AIR CHARGE.

The electronic payment device 220, whether a POS terminal, mobile communication device or computer that processes on-line transactions, generates electronic transaction data 222 and communicates with the consumer's mobile communication device 210 via a network connection such as a wireless and temporary, close proximity or short range connection such as a near field communication (NFC) connection.

Examples of other networks 260*a-c* (generally, "network" 260) that may be utilized for communications between system 200 components include but are not limited to a NFC connection as noted above, a Local Area Network (LAN), a Wide Area Network (WAN), Metropolitan Area Network (MAN), a wireless network, other suitable networks capable of transmitting data, and a combination of such networks. For ease of explanation, reference is made to a network 260 generally, but various networks 260 and communication methods may be utilized.

In the illustrated embodiment, the bid computer 230 configured according to embodiments includes a bid analysis or management program (generally, "analysis program 232) and is in communication with the mobile communication device 210 and computers 240*a-c* (generally, "computer" or "issuer computer" 240) of respective issuers 245*a-c* (generally, "issuer" 245) such that the bid computer 230 serves as an intermediary to receive and transmit issuer authorizations and electronic payments, and to manage generation of bid or offer requests 231, issuer responses or offers 241 and analyze the issuer offers 241 according to embodiments. Depending on the system configuration utilized and how the bid computer 230 is configured, the merchant's electronic payment device 220 may also be in communication with issuer computers for purposes of authorization and/or payment processing, and there may be other system computers that are utilized to process electronic payments, merchant accounts and/or manage cloud wallet data of various consumers, as shown in FIG. 3.

Figure 3:
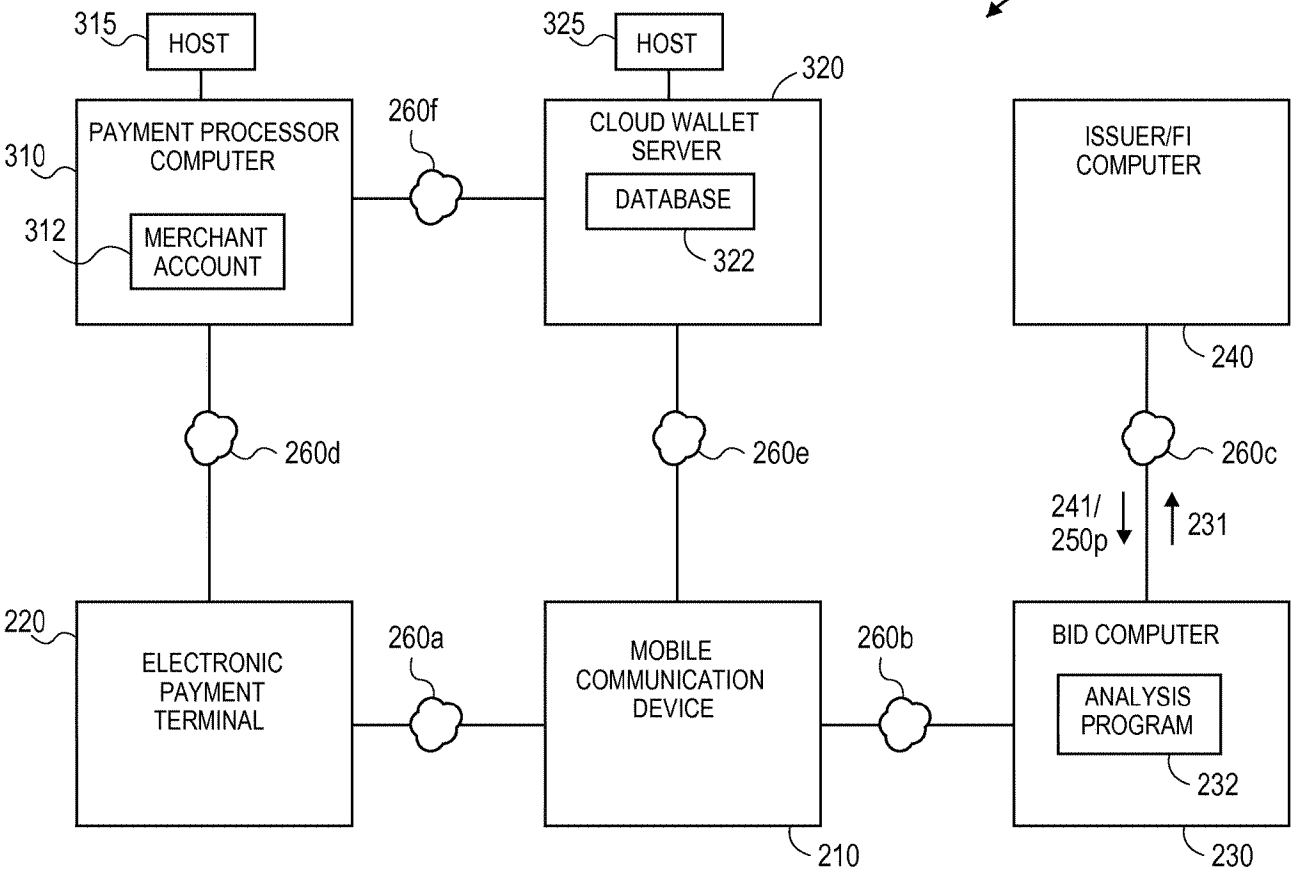
FIG. 3 is a block diagram of another system constructed according to one embodiment for allowing issuers of electronic payment instruments to bid or compete for use of their electronic payment instruments to complete an electronic transaction.

Referring to FIG. 3, a system 300 constructed according to one embodiment and configured for using the mobile communication device 210 as a mobile wallet includes or involves the mobile communication device 210, electronic payment device 220, bid computer 230 and issuer computers 240 as discussed above, and a computer 310 of a host or payment processor 315 that processes transactions and manages or accesses a merchant account 312 on behalf of the merchant 225, and a cloud computer, server or resource (generally, cloud computer 320) of a host 325 that manages a database 322 containing data of available electronic payment instruments 250 (e.g., consumer name, credit card number, issuer, expiration date, security code or card verification code).

In the embodiment illustrated in FIG. 3, the mobile communication device 210 is in communication with the electronic payment device 220, bid computer 230 and cloud computer 320, the electronic payment device 220 is also in communication with the payment processor computer 310 (and issuer computers 240 as necessary for authorization), and the payment processor computer 310 is also in communication with the cloud computer 320 via respective networks 260. It will be understood that other system 300 configurations may be utilized, e.g., the bid computer 220 may host the analysis program 232 and the merchant account 312 while also being in communication with issuer computers 240 and the cloud computer 320. Thus, FIG. 3 is provided as one example to generally illustrate other parties and system components involved in one implementation of a system providing for mobile wallet payments using mobile communication device 210.

In the illustrated embodiment, the consumer has one or more electronic payment instruments 250 such as credit cards, and registers with cloud computer 320, which serves as a cloud wallet resource or computer and stores consumer's credit card data in a database 322. The payment processor 315 and/or bid computer 230 provides services of processing transactions involving forms of electronic payment such as a credit card and serves as an intermediary between the consumer 215 and issuer 245, which is the recipient of proceeds of the transaction. The payment processor 315 hosts or manages a merchant account 312 on behalf of the merchant 215. The merchant account 312 allows the merchant 215 to accept payment using a credit card and other electronic payment instruments 250. Examples of payment processors 315 or payment processing systems that provide these types of services include, for example, Innovative Merchant Solutions (an Intuit Inc. company), CHASE PAYMENTECH and EVALON.

In one embodiment as illustrated in FIG. 3, the computer 310 that hosts the merchant account 312 is separate from the bid computer 230, but in other embodiments, the bid computer 230 also manages the merchant account 312. It will be understood According to other embodiments, a separate merchant account or payment processor is utilized such that the bid computer and payment processor computers are separate computers and may be managed by different hosts.

In the illustrated embodiment, the merchant account 312 resides on the payment processor computer 310, but the merchant account 312 may also reside on another computer that is accessed by the payment processor 310. For example, the other computer may host a financial management system (FMS) that is used solely for financial management (severable from tax strategies and not limiting use of any tax strategy), an example of which is an on-line accounting program such as quickbooks.com. QUICKBOOKS is available from Intuit, Inc. A merchant account 312 managed using the FMS can be updated by the payment processor computer 310. Thus, it should be understood that FIG. 3 illustrates one system 300 configuration that may be utilized for mobile wallet payment processing.

Figure 4:
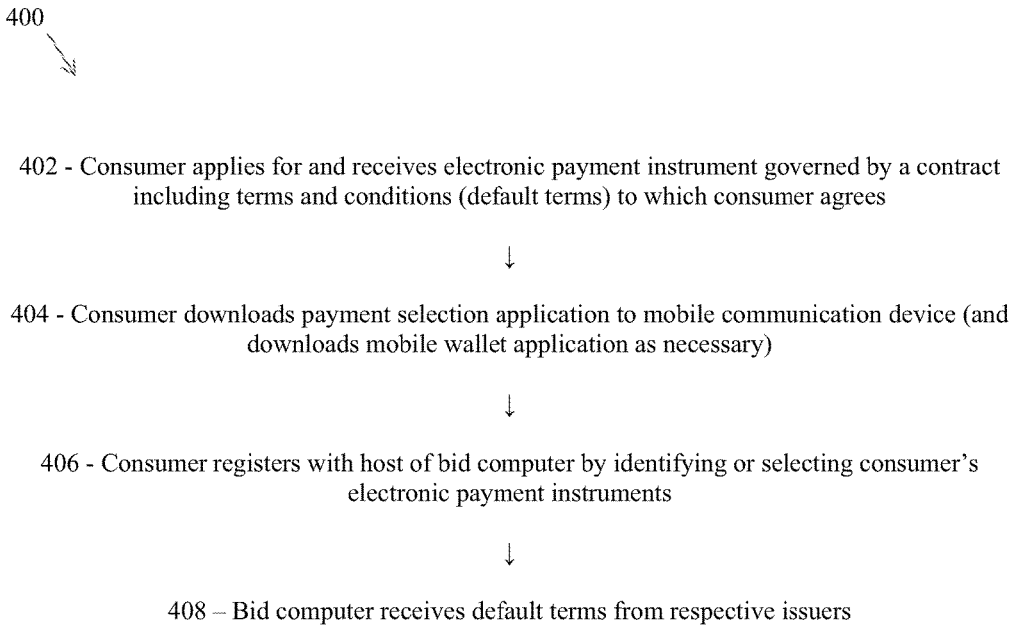
FIG. 4 is a flow diagram illustrating a consumer acquiring an electronic payment instrument governed by default terms and conditions, and registration of the consumer's electronic payment instruments with a bid computer according to embodiments.

Referring to FIG. 4, and with continuing reference to FIGS. 2-3, before embodiments can be utilized to analyze competing offers 241 from issuers 245 of the consumer's electronic payment instruments 250 and to advise the consumer 215 of the benefits conferred to the consumer 215 in view of those offers 241, at 402, the consumer 215 applies for and receives an electronic payment instrument 250 governed by a contract including terms and conditions 251*d* (generally, "default terms 251*d*") to which consumer 215 agrees. For example, a default term 251*d* may involve a default fixed or variable interest rate (e.g., 19%) or default rewards program such as 1 mile good for travel for every $1 spent, 1 point for every $1 spent that can be redeemed for rewards including cash, gift cards, or pre-determined items or awards, or a pre-determined amount or percentage cash back for purchases. For ease of explanation, reference is made generally to a default term 251*d*, and which is a term or condition that currently applies and governs use of the electronic payment instrument 250.

At 404, the consumer 215 downloads the payment selection application 212 to the mobile communication device 210 if the payment selection application 212 is not a native application. The payment selection application 212 may be downloaded from the bid application computer 230 or another source.

At 406, the consumer 215 registers with the bid computer 230 by identifying or selecting the consumer's electronic payment instruments 250, and at 408, the bid computer 230 receives or determines default terms 251*d* for the consumer's electronic payment instruments 250 by, for example, entry of data by the consumer 215, entered manually by host 235, or via an application program interface (API) or screen scraping of a screen of a source of the issuer 245. Default terms 251*d* may include one or more of APR or interest rate (fixed or variable), credit limit, rewards terms such as points, miles, cash back, and other terms.

Referring to FIG. 5, default terms 251*d* may be stored in a database or table 500 that includes columns or entries 502*a-d* for identification of the consumer 215, identification of an electronic payment instrument 250, identification of the issuer 245 of the electronic payment instrument 250, and default terms 251*d*. These default terms 251*d* are terms to which the consumer 215 has already agreed by applying for and utilizing the electronic payment instrument 250.

Figure 6:
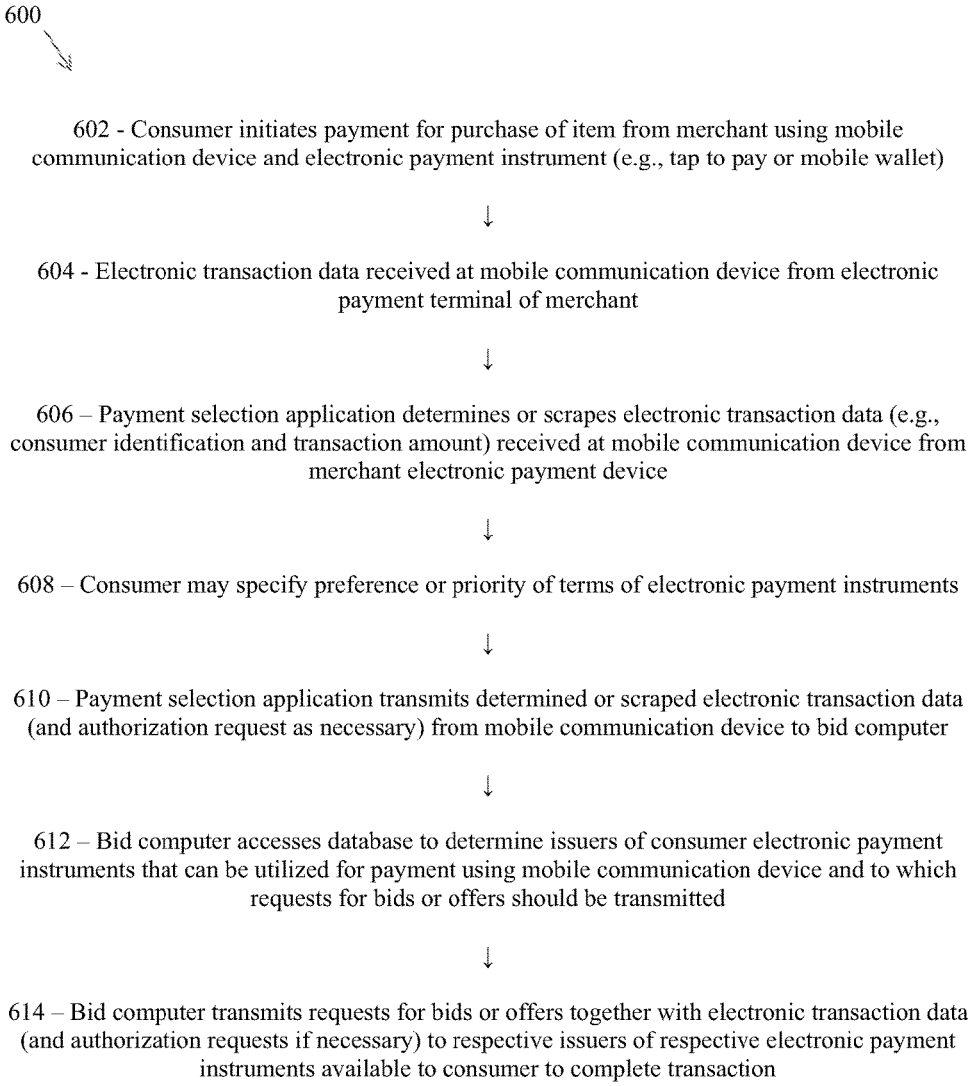
FIG. 6 is a flow diagram illustrating process steps according to embodiments and resulting in a bid computer transmitting requests for bids or offers to issuers of electronic payment instruments of a consumer and issuer responding with offers including proposed terms and conditions if their electronic payment instruments are utilized for the transaction, in real-time during a transaction involving the consumer and a merchant.

Referring to FIG. 6, and with continuing reference to FIGS. 2-5, a method 600 for real-time electronic bidding by issuers 245 to select an electronic payment instrument 250 to be utilized by the consumer 215 based on benefits or rewards of issuer offers 241 that would be conferred to the consumer 215 involves, at 602, the consumer 215 initiating, but not completing, an electronic payment for purchase of item from a merchant 215 using the consumer's computing or mobile communication device 210. Embodiments are described with reference to a mobile communication device 210 in the form of a smartphone operable as a mobile wallet and including or accessing electronic payment instrument data 322. For this purpose, the consumer 215 may position the mobile communication device 210 to contact or "tap" the merchant's electronic payment device 220, or be positioned in close proximity to the electronic payment device 220. The mobile communication device 210 and electronic payment device 220 are equipped with network components such as respective NFC chips or cards, which are utilized to establish a NFC or other wireless connection 160 between the devices 210, 220.

At 604, the merchant 225 begins processing of the transaction by scanning or entering data of the item(s) being purchased by the consumer 215 and generates an electronic receipt, invoice or electronic transaction data 222. Electronic transaction data 222 is transmitted from the electronic payment device 210 to the mobile communication device 220 via the wireless or NFC connection (or via cloud server 320 depending on the system configuration employed).

At 606, the payment selection application 212 is manually activated by the consumer 215 or automatically upon establishment of a wireless or NFC connection or in response to receiving a communication from electronic payment device 210. Payment selection application 212 determines or scrapes electronic transaction data 222 received from the electronic payment device 210. Electronic transaction data 222 that is determined or scraped may include identification of the consumer 215 and a transaction amount, and as necessary, other data that may be useful in assisting the issuer 245 to determine whether to submit an offer 241 and proposed terms of such offers 241 such as identification of the merchant 225 and items or categories of items purchased.

According to certain embodiments, at 608, payment selection application 212 may allow the consumer 215 to indicate a priority or preference of a term 251 applicable to an electronic payment instrument 250.

For example, the consumer 215 may indicate using an interface generated by the payment selection application 212 and displayed on a screen of the mobile communication device 210 that the consumer 215 considers APR or interest rate to be the most important term 251. This may be the case, for example, if the consumer 215 carries a credit card balance such that the interest rate has a significant impact on monthly payments and overall cost of the item due to interest and balances carried over to future statements). As another example, the consumer 215 may prefer points awarded for purchases (e.g., to redeem for cash or item) or miles awarded for purchases (to redeem for travel or hotel if the consumer is close to a points or miles) and prefers points or miles since the consumer 215 is near a milestone and wants to redeem the points after reaching that milestone. As a further example, the consumer's pending purchase may involve an expensive or big ticket item such that the consumer 215 may prefer a lower interest rate compared to other benefits or rewards since a larger balance will be carried on the credit card 250 before the purchase is paid in full with interest. Thus, the consumer 215 may prefer or prioritize various terms 251 for various reasons, and embodiments allow the consumer 215 to specify a preference or priority if desired, and any priority or preference can be transmitted with electronic transaction data 222 to the bid computer 230.

At 610, the payment selection application 212 transmits the electronic transaction data 222 (and any term 251 preference or priority specified by the consumer 125) to the bid computer 230, and at 612, the analysis program 232 of or accessed by the bid computer 230 receives the electronic transaction data 222, accesses the database or table 500, and looks up information about the electronic payment instruments 250 available to the consumer 215 and issuers 245 thereof and to which requests 231 for bids to fund the transaction should be transmitted.

At 614, the analysis program 232 transmits requests 231 for bids or offers from the bid computer 230 to computers 240 of identified issuers 245, and in certain embodiments, also transmits the consumer's term preference and priority and/or authorization requests (e.g., based on the transaction amount) to issuer computers 240. At 616, issuer computers 240 determine whether the transaction should be approved (e.g. based on transaction amount and available credit), and at 618, determine offers 241 to be submitted to the consumer 215 if the issuers 245 participate in the real-time bidding process provided by the bid computer 230. If so, then each issuer 245 determines its bid or offer 241 including proposed terms 251*p* ("p" indicating "proposed") to fund electronic transaction based at least in part upon electronic transaction data 222 and default terms 251*d* of issuer's electronic payment instrument 250.

For example, the issuer 245 may try to influence or entice the consumer 215 to select that issuer's electronic payment instrument 250 by offering that the purchase will involve a proposed term 251*p* of a reduced APR (e.g., 10% rather than the default 19%), or that the issuer 245 would award the consumer 215 with more points, miles or cash back than the points, miles, or cash back specified in the default terms 251*d*. If the consumer 215 has specified a term preference or priority, the bid computer 230 may limit issuers 245 to presenting offers 241 based on the preference or priority, or issuers 245 may consider preference or priority when preparing their offers 241.

At 620, the issuers' offers or responses 241 to requests 231 for bids are transmitted (directly or indirectly through acquirer) to the bid computer 230, independently of or together with respective authorization decisions of the issuer 245. If the issuer 245 decides that the transaction using the issuer's electronic payment instrument 250 should be declined (e.g., the consumer 215 would go over a credit limit), then the issuer 245 can transmit data indicating the transaction is declined without submitting an offer 241 in response to the bid request 231. Further, if the bid computer 230 is not involved in authorization, authorization requests and data indicating that the transaction is approved or declined can be completed using known communications involving a merchant computer 210 (and acquirer computer as necessary).

At 622, for each issuer 245 or for each issuer response 241, the analysis program 232 determines whether the issuer 245 approved the transaction, and if so, also submitted an offer 241 to the bid computer 230 in response to the bid request 231. If the transaction is not approved, then at 624, the issuer 245 and electronic payment instrument 250 of the issuer 245 is eliminated from further consideration. If the transaction was approved, then at 626, the analysis program 232 further determines whether the issuer's offer 241 was received within a pre-determined amount of time.

According to certain embodiments, and to facilitate use by the merchant 215 and consumer 225 in real-time during a pending transaction, the bid request 231 sent by the bid computer 230 is time-limited such that the issuer 245, in order to be considered by the bid computer 230, must respond with an offer 241 within a pre-determined amount of time. This reduces transaction processing delays and ensures the analysis being performed is transparent to the consumer 215 and merchant 225. If the issuer 245 responded with an offer 241 including proposed terms 251*p*, but did not respond quickly enough, the electronic payment instrument 250 of the issuer 245 may be eliminated from consideration, or the default terms 251*d* of the electronic payment instrument 250 can be utilized by the analysis program 232. If the issuer 245 did respond within the pre-determined amount of time, then the process continues to FIG. 7.

Referring to FIG. 7, at 702, issuers 245 desiring to participate in the real-time bidding process transmit their respective payment authorization determinations (as necessary, or directly to merchant computer 220 as discussed above) and timely submit their offers 241 in response to bid requests 231 to the bid computer 230. At 704, the analysis program 232 determines the proposed terms 251*p* of the received offers 241 and, as necessary, default terms 251*d* of electronic payment instruments 250 (e.g., if an issuer 245 did not respond within the pre-determined time or declined to participate in the bidding process or declined to submit an offer 241 with proposed terms 251*p* that are better than default terms 251*d*).

At 706, the analysis program 232 normalizes or standardizes proposed terms 251*p* of offers 241 as necessary. For example, it may be that all of the offers 241 received at bid computer 230 involve the same term 251 such that the bid program 232 can perform a direct comparison of the proposed terms 251*p* of offers 241 (and the same default term 251*d* as necessary). Issuer offers 241 may involve a common term 251 such that normalization is not required, whereas other offers 241 may involve different types of terms 251 such that direct comparison is not possible. In these cases, the different proposed terms 251*p* and/or default terms 251*d* are normalized, transformed or converted into a common unit, term or denominator so that they can be compared with each other to assess the benefit conferred to the consumer 215.

For example, a proposed term 251*p* of one offer 241 from an issuer 245 may involve APR, whereas a proposed term 251*p* of another offer 241 from another issuer 245 involves a rewards program such as points (which can be redeemed for items, cash, gift cards, etc.), miles (which can be redeemed for travel, upgrades, hotels), or cash back program. In these cases, one manner of normalizing different terms 251 of different offers 241 is to assign weights to each term 251 and/or normalize the term to a common unit such as a benefit or reward per dollar yielding a certain portion of a dollar saved as a result of a lower interest rate or a number of points needed to redeem $1 worth of merchandise, or a number of miles needed to receive $1 in travel rewards.

As another example, different proposed terms 251*p* of different offers 241 can be normalized in terms of a degree or relative improvement compared to a default term 251*d* or how much more beneficial a proposed term 251*p* is relative to a default term 251*d*. One example is how much an interest rate was lowered compared to a default interest rate (e.g., a 25% reduction due to a default interest rate of 20% and a proposed interest rate of 15%) or how many more miles would be awarded compared to a default number of miles (e.g., a 100% increase in miles rewarded). It will be understood that different offer terms 251 can be normalized in different ways to different unites and bases of comparison, and the above examples are provided to illustrate one manner in which embodiments may be implemented.

At 708, the analysis program 232 compares proposed terms 251*p* of issuer offers 241 participating in real-time bidding process (e.g., direct comparison for the same terms or comparison of normalized terms as discussed above with reference to 706) and, as necessary, default terms 251*d* of other issuers 245. At 710, in certain embodiments, the analysis program 232 submits another bid request 231 to an issuer computer 240 if that issuer 245 indicated that it would match or beat an offer 241 of another issuer. The analysis program 232 notifies that issuer 245 that its offer 241 is not the best offer, thus giving that issuer 245 an opportunity to submit a stronger offer 241 to the bid computer 230 before presenting results to the consumer. This process is transparent to the consumer 215 and merchant 225.

At 712, the bid computer 230 receives any additional offers 241 in response to 710 discussed above, and normalizes or standardizes any additional proposed terms 251*p* and/or default terms 251*d* as necessary.

At 714, the analysis program 232 compares received offers 241, and at 716, identifies or selects an electronic payment instrument 250*s* ("s" indicating "selected" electronic payment instrument) that is determined to provide the maximum benefit to the consumer 215. In another embodiment, 714 involves the analysis program 232 generating a list or ranking of electronic payment instruments 250 based at least in part upon comparison and indicating which electronic payment instrument(s) would provide the best or better benefit to the consumer 250.

At 718, the results, whether identification of an electronic payment instrument 250*s* selected by the analysis program 232, or a ranking of available electronic payment instruments 250, is transmitted from the bid computer 230 to the mobile communication device 210. According to one embodiment, only identification of the selected electronic payment instrument(s) 250*s* is transmitted. According to another embodiment, details of the determined benefits based on the proposed offer terms 251*p* are also transmitted to the mobile communication device 210 so that the consumer 215 can see the differences between benefits of different offers 241 relating to different electronic payment instruments 250. For example, one issuer 245 may present such a strong offer that there is a substantial difference between that offer and other offers of other issuers, or the best offer may only be the best by a small margin. This allows the consumer 215 to better understand why a particular electronic payment instrument 250 was selected or ranked as it was. The electronic payment instrument 250 to be utilized may thus be selected by the analysis program 232 or by the consumer 215.

According to one embodiment, after the consumer 215 receives the electronic payment instrument 250*s* selected by the analysis program 232 as providing the maximum benefit to the consumer 215, or after the consumer 215 selects one from a list ranking the electronic payment instruments 250, at 720, the consumer 215 may indicate a preference or priority (if not previously specified during FIG. 6, 608) to be considered such that the analysis program 232 would reanalyze the offers 241 in view of the preference or priority, and modify the selection or ranking if necessary at 720. At 722, the consumer 215 confirms that selected electronic payment instrument 250*s* is to be utilized or manually selects an electronic payment instrument 250 from list generated by payment selection computer 230, and at 724, the electronic transaction completed with the selected electronic payment instrument 250. At 726, the transaction is processed and finalized, e.g., by one or more of an issuer computer 245, payment processor computer 310 and cloud wallet server 320, and the consumer 215 receives benefit of using selected electronic payment instrument 250 according to the proposed terms 251*p* of the issuer offer 241 accepted by use of that issuer's electronic payment instrument 250, or if selected electronic payment instrument was not the subject of bid response, according to default terms 251*d* to which consumer 215 previously agreed.

Figure 8:
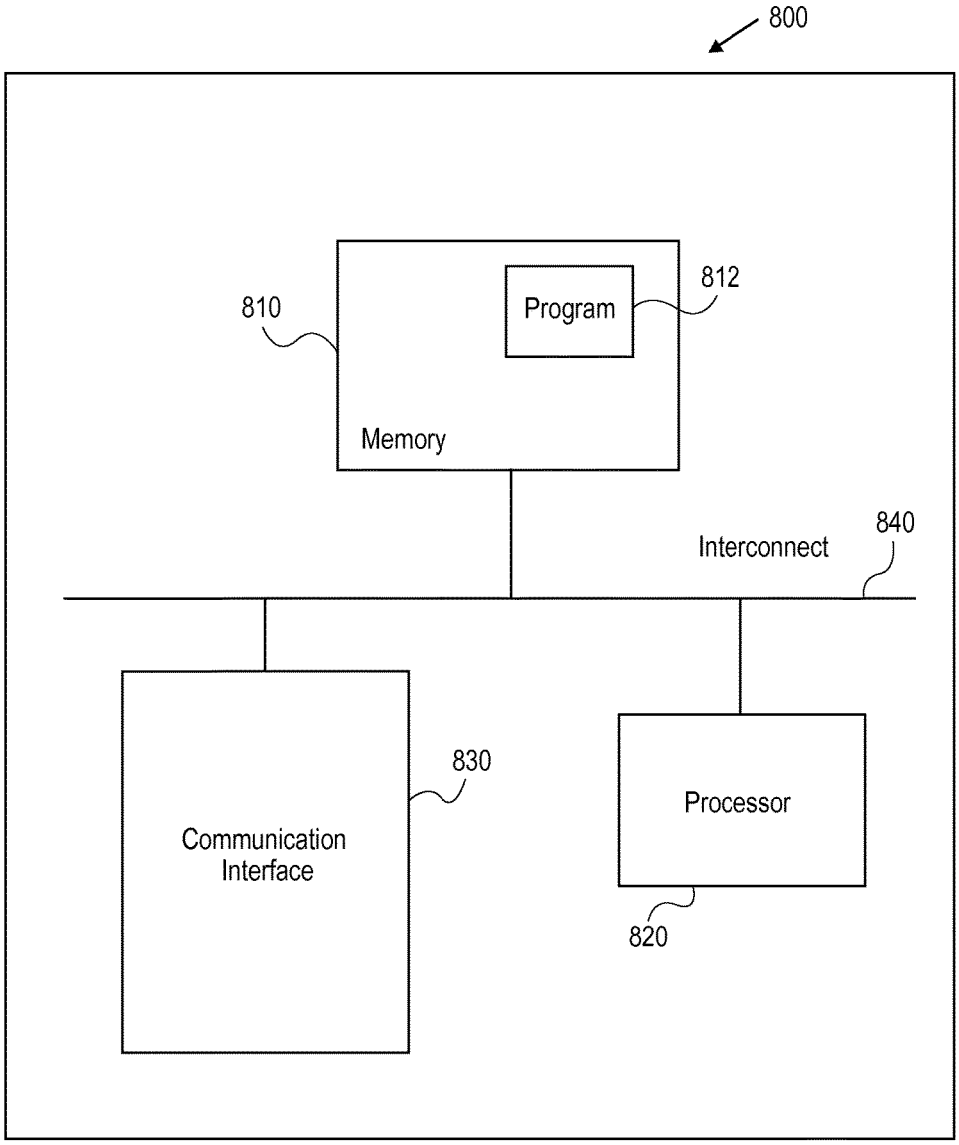
FIG. 8 is a flow diagram of one embodiment of a method for generating an authentication token with a mobile communication device of a consumer for use in processing an electronic transaction without providing electronic payment data to the merchant.

FIG. 8 generally illustrates components of a computing device 800 that may be utilized to execute embodiments and that includes a memory 810, program instructions 812, a processor or controller 820 to execute program instructions 812, a network or communications interface 830, e.g., for communications with a network or interconnect 840 between such components. The memory 810 may be or include one or more of cache, RAM, ROM, SRAM, DRAM, RDRAM, EEPROM and other types of volatile or non-volatile memory capable of storing data. The processor unit 820 may be or include multiple processors, a single threaded processor, a multi-threaded processor, a multi-core processor, or other type of processor capable of processing data. Depending on the particular system component (e.g., whether the component is a computer or a hand held mobile communications device), the interconnect 840 may include a system bus, LDT, PCI, ISA, or other types of buses, and the communications or network interface may, for example, be an Ethernet interface, a Frame Relay interface, or other interface. The network interface 830 may be configured to enable a system component to communicate with other system components across a network which may be a wireless or various other networks. It should be noted that one or more components of computing device 800 may be located remotely and accessed via a network. Accordingly, the system configuration provided in FIG. 8 is provided to generally illustrate how embodiments may be configured and implemented.

Method embodiments or certain steps thereof, may be embodied in a computer program product such as an application that can be downloaded to an electronic payment device of the merchant, to a mobile communication device of the merchant, and to a mobile communication device of the consumer. Method embodiments or certain steps thereof may also be carried out by execution of software instructions that are embodied in, or readable from, a non-transitory, tangible medium or computer-readable medium or carrier or article of manufacture, e.g., one or more of the fixed and/or removable data storage data devices and/or data communications devices connected to a computer. Carriers may be, for example, magnetic storage medium, optical storage medium and magneto-optical storage medium. Examples of carriers include, but are not limited to, a floppy diskette, a memory stick or a flash drive, CD-R, CD-RW, CD-ROM, DVD-R, DVD-RW, or other carrier now known or later developed capable of storing data. The processor 820 performs steps or executes program instructions 812 within memory 810 and/or embodied on the carrier to implement method embodiments.

Although certain embodiments have been shown and described, it will be understood that the above discussion does not limit the scope of these embodiments. While embodiments and variations of the many aspects of the invention have been disclosed and described herein, such disclosure is provided for purposes of explanation and illustration only. Thus, various changes and modifications may be made without departing from the scope of the claims.

Further, while embodiments are described with reference to a credit card transaction and issuers of credit cards, embodiments may involve various types of electronic payment. Moreover, while certain embodiments are described with reference to an analysis program selecting or identifying an electronic payment instrument of an issuer that has presented an offer that maximizes a benefit to the consumer, embodiments are not so limited, and may involve selection of an electronic payment instrument that does not maximize the benefit to the consumer if, for example, the consumer has specified a preference or priority of a certain term, and an offer by an issuer involving that particular term confers a benefit that is less than an offer from another issuer involving a different term.

Additionally, it will be understood that embodiments may involve comparisons or analysis of the same types of terms, i.e., offers and direct comparisons involving only APR, only miles, only points, or only cash back, or offers and comparisons of different terms after normalization, such as comparison of APR and points, APR and miles, APR and cash back, points and miles, points and cash back, miles and cash back, APR, points and miles, APR points and cash back, APR miles and cash back, and APR, points, miles and cash back, and other terms and combinations involving other terms. Thus, embodiments may involve comparisons of terms of different numbers and different types of terms, and of the same type or different type of electronic payment instruments.

Moreover, it will be understood that comparisons may involve only terms, or terms and aspects of consumer accounts such as consumer priorities or preferences, the frequency with which a consumer utilizes an electronic payment instrument, balances, amount of interest paid, how close a consumer is to redeeming a cash, travel or other reward, and whether the consumer is behind on payments of certain electronic payment instruments. For this purpose, the bid computer may host a financial management system utilized by the consumer that includes account information or receive such information from the issuer.

Additionally, embodiments may involve comparisons of only proposed terms of issuer offers submitted in response to bid requests, comparisons of a proposed term of an issuer offer submitted in response to a bid request and a default term (e.g., if an issuer did not respond, did not timely respond, or does not participating in the real-time bidding system), or comparisons of only default terms (e.g., if no issuer responded to the bid requests, or did not timely respond). Embodiments may also involve analysis of only default terms, and analysis of default terms may or may not involve submitting bid requests to issuers.

Further, while certain embodiments are described with reference to issuer offers including terms that would apply to the particular pending purchase, embodiments may also involve offers that apply to one or more future purchases, or for a pre-determined time following the currently pending purchase. For example, an issuer offer may specify that a reduced APR would apply to a current purchase if the consumer utilized the issuer's credit card, but also for the next three purchases using the issuer's credit card, or for all purchases for the next week.

Moreover, certain embodiments are described with reference to a mobile communication device operable as a mobile wallet but may also apply to on-line purchases that may be made from a consumer's laptop, desktop or tablet computing apparatus, e.g., while the consumer is at home, at the office or some other remote location relative to the merchant.

While multiple embodiments and variations of the many aspects of the invention have been disclosed and described herein, such disclosure is provided for purposes of illustration only. Where methods and steps described above indicate certain events occurring in certain order, those of ordinary skill in the art having the benefit of this disclosure would recognize that the ordering of certain steps may be modified and that such modifications are in accordance with the variations of the invention. Additionally, certain of the steps may be performed concurrently in a parallel process when possible, as well as performed sequentially. Accordingly, embodiments are intended to exemplify alternatives, modifications, and equivalents that may fall within the scope of the claims.

What is claimed is:

1. A computer-implemented method for real-time electronic bidding by issuers to select an electronic payment instrument to be utilized by a consumer to complete a pending transaction for purchase of an item by the consumer from a merchant, the method comprising:

an intermediate bid analysis computer, in communication through respective communication networks with a mobile communication device of the consumer and respective computers of respective issuers of respective electronic payment instruments available to the consumer, receiving electronic transaction data for an item selected for purchase by the consumer, the electronic transaction data being received from the mobile communication device in real-time during a pending transaction, after the pending transaction has been initiated to purchase the item, and before the pending transaction has been completed, the mobile communication device comprising data of respective electronic payment instruments available for use by the consumer and being operable as a mobile wallet, each electronic payment instrument being governed according to default contract terms to which the consumer previously agreed to use the electronic payment instrument;

the intermediate bid analysis computer transmitting the electronic transaction data and respective bid requests to respective issuer computers, respective bid requests comprising a response time restriction such that a response must be received by the intermediate bid analysis computer from an issuer computer within a pre-determined time to be considered by the intermediate bid analysis computer;

the intermediate bid analysis computer receiving respective responses from respective issuer computers, comparing the pre-determined time and respective response times of respective issuer computers and selecting responses that were received within the pre-determined time, each selected response comprising an offer by an issuer that would apply if the electronic instrument of the issuer is utilized to complete the pending transaction, a first selected response comprising a first offer comprising default terms governing a first electronic payment instrument issued to the consumer by the first issuer, and a second selected response comprising a second offer comprising proposed terms that differ from default terms governing a second electronic payment instrument issued to the consumer by the second issuer; and the intermediate bid analysis computer comparing the respective offers comprising the first offer and the second offer, an electronic payment instrument being selected to complete the pending transaction based at least in part upon the comparison.

2. The method of claim 1, further comprising the intermediate bid analysis computer sending an authorization request to an issuer computer and receiving data indicating whether the issuer computer authorized use of the electronic payment instrument for the transaction together with a response to the bid request when the issuer computer authorized use of the electronic payment instrument for the transaction.

3. The method of claim 1, the consumer being at an electronic payment device of the merchant and within the merchant's establishment while the intermediate bid analysis computer receives electronic transaction data from the mobile communication device, transmits electronic transaction data and respective bid requests to respective issuer computers, and receives respective responses from respective issuer computers.

4. The method of claim 1, the consumer being located remotely relative to a location of the merchant.

5. The method of claim 1, the intermediate bid analysis computer selecting the electronic payment instrument for the consumer based at least in part upon comparing the first offer and the second offer.

6. The method of claim 5, the intermediate bid analysis computer notifying the consumer of the selected electronic payment instrument by transmitting an electronic message to the mobile communication device, the selected electronic payment instrument being confirmed and utilized by the consumer to complete the pending transaction.

7. The method of claim 5, the intermediate bid analysis computer selecting the electronic payment instrument based at least in part upon an offer of a selected response that is associated with the selected electronic payment instrument providing a maximum benefit to the consumer compared to other offers of other selected responses that are associated with other electronic payment instruments of other issuers.

8. The method of claim 7, the maximum benefit involving a rewards program offered by the issuer of the selected payment instrument.

9. The method of claim 7, the maximum benefit involving an annual percentage rate charged by the issuer of the selected payment instrument.

10. The method of claim 1, further comprising the intermediate bid analysis computer transmitting the first offer and the second offer to the mobile communication device to notify the consumer of the first offer and the second offer, the electronic payment instrument to be utilized for the transaction being selected by the consumer.

11. The method of claim 1, further comprising the intermediate bid analysis computer generating a list of the plurality of electronic payment instruments ranked based at least in part upon comparing respective offers of respective selected responses, and transmitting the list to the mobile communication device, the consumer selecting an electronic payment instrument from the list.

12. The method of claim 1, a selected offer by a particular issuer comprising a proposed term that is more favorable than a default term of a contract of the particular issuer, wherein the consumer would receive the benefit of the proposed term when the pending transaction is completed using the electronic payment instrument of the particular issuer.

13. The method of claim 12, the default term comprising a default annual percentage rate, and the proposed term comprising an annual percentage rate that is lower than the default annual percentage rate.

14. The method of claim 13, the proposed term being applicable to the specific pending transaction for which the offer was submitted by the issuer.

15. The method of claim 12, the default term comprising a default number of points or miles awarded for the transaction amount, and the proposed term comprising a number of points or miles that is greater than the default number.

16. The method of claim 15, the proposed term being applicable to the specific pending transaction for which the offer was submitted by the issuer.

17. The method of claim 1, when the intermediate bid analysis computer does not receive a response to a bid request within the pre-determined time, the method further comprising the intermediate bid analysis computer comparing a default term of the contract of the issuer that did not respond to the bid request within the pre-determined time relative to proposed terms of offers of other issuers.

18. The method of claim 1, the intermediate bid analysis computer comparing the same type of proposed terms of respective offers of respective selected responses.

19. The method of claim 18, a proposed term comprising an annual percentage rate, the intermediate bid analysis computer comparing a first annual percentage rate of the first offer of the first selected response and a second annual percentage rate of the second offer of the second selected response.

20. The method of claim 18, a proposed term comprising a term of a rewards program, the intermediate bid analysis computer comparing a first rewards program term of the first offer of the first selected response and a second rewards program term of the second offer of the second selected response.

21. The method of claim 1, the intermediate bid analysis computer comparing respective offers of comprising the intermediate bid analysis computer comparing different types of proposed terms of respective offers of respective selected responses.

22. The method of claim 21, further comprising the intermediate bid analysis computer normalizing the different types of proposed terms of respective offers of respective selected responses into a common metric or standard;

comparing the terms based on the common metric or standard, and determining which proposed term is more beneficial to the consumer based at least in part upon the comparison of terms based on the common metric or standard.

23. The method of claim 22, the intermediate bid analysis computer normalizing a first proposed term comprising an annual percentage rate of the first offer and a second proposed term comprising a rewards program of the second offer.

24. The method of claim 22, the intermediate bid analysis computer normalizing a first proposed term of first offer comprising a number of miles to be awarded for the transaction amount and a second proposed term of the second offer comprising a number of points to be awarded for the transaction amount.

25. The method of claim 1, at least one of the electronic payment instruments comprising a credit card.

26. The method of claim 1, the electronic transaction data transmitted with the respective bid requests by the intermediate bid analysis computer to respective issuer computers comprising an identification of the consumer and an amount of the pending transaction.

27. The method of claim 1, the intermediate bid analysis computer receiving the electronic transaction data after a wireless connection is established between the mobile communication device and an electronic payment device of the merchant to initiate the pending transaction.

* * * * *